US007376051B2

(12) United States Patent
Rosen

(10) Patent No.: US 7,376,051 B2
(45) Date of Patent: May 20, 2008

(54) CLOCK WITH SELECTED AUDIO MESSAGES

(75) Inventor: Lauren Rosen, Farmington Hills, MI (US)

(73) Assignee: Trivicor International LLC, Okemos, MI (US)

( * ) Notice: Subject to any disclaimer, the term of this patent is extended or adjusted under 35 U.S.C. 154(b) by 96 days.

(21) Appl. No.: 11/373,469

(22) Filed: Mar. 10, 2006

(65) Prior Publication Data

US 2007/0211575 A1 Sep. 13, 2007

(51) Int. Cl.
*G04C 99/00* (2006.01)

(52) U.S. Cl. ..... 368/63; 368/111

(58) Field of Classification Search ..... 368/63
See application file for complete search history.

(56) References Cited

U.S. PATENT DOCUMENTS

| | | | | |
|---|---|---|---|---|
| 1,750,505 | A | 3/1930 | Bulka | |
| 4,583,864 | A | 4/1986 | Graves | |
| 4,659,231 | A | 4/1987 | Barkouki | |
| 4,711,583 | A | 12/1987 | Oechslin et al. | |
| 4,712,923 | A | 12/1987 | Martin | 368/10 |
| 4,759,002 | A | 7/1988 | Cash | |
| 4,766,579 | A | 8/1988 | Sporring | |
| 5,023,849 | A | 6/1991 | Vaucher | |
| 5,457,663 | A | 10/1995 | Mejaski | |
| 5,511,046 | A * | 4/1996 | Vanderpal | 368/63 |
| 5,555,536 | A * | 9/1996 | Rolf et al. | 368/98 |
| 6,222,796 | B1 | 4/2001 | Rosen | |
| 6,580,663 | B1 | 6/2003 | Whitmore | |
| 6,678,215 | B1 * | 1/2004 | Treyz et al. | 368/10 |
| 6,791,904 | B1 | 9/2004 | Herron et al. | |
| 6,795,377 | B2 | 9/2004 | Gorden | 368/12 |
| 6,998,961 | B2 | 2/2006 | Stihler | 368/12 |
| 2005/0013198 | A1 | 1/2005 | Born et al. | |
| 2005/0169110 | A1 * | 8/2005 | Mazzilli et al. | 368/73 |
| 2007/0057775 | A1 * | 3/2007 | O'Reilly et al. | 340/309 |

* cited by examiner

*Primary Examiner*—Renee S Luebke
(74) *Attorney, Agent, or Firm*—Thomas M. Freiburger

(57) ABSTRACT

A clock has a solid state memory or other storage medium containing many messages, each of which preferably is appropriate to a particular date, time of day, week, season, etc. The clock is self-contained, without connection to any network for message content. In setting the clock the user can choose that a message be selected by the internal microprocessor at the appointed time. A specific embodiment is a clock radio which can be set for alarm, radio programming and/or day-specific message. The stored messages are presented in verbal form for the user, via digital storage or voice synthesizer. In specific forms the clock or clock radio contains messages relating to similar dates in history, horoscopes based on the user's birth date, anonymous-type programs, or other messages that have appropriate content for a particular time or date.

34 Claims, 3 Drawing Sheets

CLOCK WITH SELECTED AUDIO MESSAGES

BACKGROUND OF THE INVENTION

This invention concerns clocks that present messages, and in specific forms of the invention, clocks, especially clock radios, that present verbal messages to wake up a person with a daily horoscope specific to the person and date, or with a message regarding an important event in history that occurred on the same date.

A previous patent of the inventor herein, U.S. Pat. No. 6,222,796, described an astrological wristwatch that stored horoscopes for up to one year and which would receive inputs of the user's birth date and time. A computer chip in the watch would select an appropriate horoscope that correlates to the current date and the user's time and date of birth, causing it to be shown on a liquid crystal display. This written display was called up when desired by the user's pressing a button on the watch.

The computer chip of the above described device, contained in the watch but replaceable, was specific to only one sign of the zodiac. On the display case of the watch was a zodiac month sign appropriate to the user.

In addition, the following patents have some relevance to the subject matter of the invention: U.S. Pat. Nos. 1,750,505, 4,583,864, 4,659,231, 4,711,583, 4,712,923, 4,759,002, 4,766,579, 5,023,849, 5,208,790, 6,580,663, 6,791,904, and published Application No. 2005/001,3198.

The Herron '904 patent listed above describes a network, which includes the Internet and a number of servers, connecting ultimately through switching devices to a series of clock radio devices which have two-way communication with audio content servers. The user is enabled to select information to be presented via the clock radio, and the patent states this information could be entertainment, jokes, horoscope, etc.

The present invention avoids the elaborate interactive network described in the Herron patent and provides a self-contained apparatus capable of presenting messages verbally and in a cost-efficient manner.

SUMMARY OF THE INVENTION

The present invention is a clock, in a preferred form a clock radio, with self-contained audio features to present to a user a message, preferably a time-appropriate message, which can be presented each day at an alarm set time. The device includes a clock with a clock body and a time display, and with a microprocessor and a digital storage medium, storing a multiplicity of messages, each preferably being appropriate for a particular time period, day or time of day. An audible output in the clock body delivers verbal messages, the output being connected to the microprocessor so as to verbally announce audio messages selected from the multiplicity of messages when so directed by the microprocessor. The microprocessor selects one of the multiplicity of messages for audio presentation to the user preferably based on time of day, day of week or date.

The term clock refers to any type of time keeping and displaying device, including wall clocks, table clocks, watches, automobile clocks, alarm clocks, clock radios, etc.

The device of the invention preferably is in the form of a clock radio, capable of being set to present a selected audio message for presentation at a wake up time, the message to be appropriate for the time, day or date for which the clock radio is set. The stored messages can be horoscopes, preferably with one horoscope for each of the twelve different zodiac signs for each day of the year, i.e. 12×365=4380 messages for one year. The clock or clock radio preferably includes a data input for the user's input of data relating to date of birth, for the purpose of selecting horoscopes.

In another form the device stores the multiplicity of messages relating to historical events, to verbally report an event from "this day in history". With this type of messages the storage medium is appropriate for many years, as opposed to the horoscope, which will change year by year. The stored medium can include several different series of messages, with several different categories of historical events, and the clock device can include a user selection for which category of message is to be delivered at the appointed time. Different types of historical events can include news events, science events, political events, sports events, or others specific to any of many different selected activities.

In one preferred embodiment the clock or clock radio has a CD and CD player, with the CD storing all messages, as digitally stored voice messages. The messages can be stored in both male and female voices, and even in a child's voice, so that the user has a choice.

In another embodiment the invention includes a solid state memory and reader, the memory being generally the type used in digital cameras or the type used as a "flash memory" for computers, etc. This type of memory can either store voice messages or simply contain text data representing the words, to be coupled with a voice synthesizer in the device. This generally results in more of a "machine" type of verbal message, but it does enable considerably more dense storage of messages and enables the use of solid state memory.

Solid state memories have been advanced in recent years to be capable of storing multiple gigabytes of data, and their density is expected to increase even further. Depending on cost, these memory devices are expected to the best means of storing the multiplicity of messages in the clock device of the invention. Programmable memory devices can be re-programmed with new sets of messages for different years when needed, as for horoscopes. Although the user could purchase a new memory card or flash memory for each year, and change the memory in the clock device, as by opening a door or slot to remove the old memory device and insert the new one, the memory can also be updated by using a computer and online connection. As a new year approaches for messages such as horoscopes, the user could go to a specific website with the memory device connected to the computer, and download (for a fee) new data appropriate for the coming year. The re-programmed memory device would then be re-installed in the clock device.

Again with such an Internet connection, more than simply generic horoscopes can be presented. The user may elect to purchase and download the horoscopes for one particular horoscope sign (such as Gemini), for one year or for several years of generic horoscopes, thus only containing 365 horoscopes for each year. Or, the user could elect to purchase and download complete, specific horoscopes, sometimes called elaborate readings, based on the user's actual date of birth, and, optionally, the time zone-adjusted time of birth. With such data downloaded over the Internet, significantly, far less data need be downloaded in the digital storage device of the user's clock. Whether date of birth specific elaborate readings are selected, or date of birth/time specific elaborate readings, only 365 such messages need be stored for each year (366 every fourth year).

In other embodiments of the invention, the messages can be of a different nature, and can include messages for alcoholics anonymous, smokers anonymous, gamblers anonymous, etc., or daily meditations, inspirational messages, trivia, various facts for children, famous quotes, medical facts, weight loss information, exercise motivational messages, or biblical passages. Although it is preferred that the radio or clock radio of the invention dispense messages that are appropriate to the particular day on which played, it can be otherwise. For example, the device can play messages for a two-week period with an educational theme, with information to be absorbed or memorized by a child, progressing each day. Different types of subject matter can be selectable. In this sense, each message, being of a series of messages with a particular chronological order, is played on a day that is appropriate to the particular message.

In another aspect the invention encompasses a clock or clock radio device that stores a multiplicity of messages whether time appropriate or not, in a self-contained unit, not connected to any network, and wherein a digital storage medium is readily changeable and updateable by the user, via a door or slot on the exterior of the device. The digital data storage can be a CD or more preferably a flash memory or memory card type solid state storage device.

It is therefore among the objects of the invention to provide a time instrument, i.e. a clock or clock radio, which contains a storage medium with a large multiplicity of different messages, to be played on dates that relate in some way to the message, as selected by the user. These and other objects, advantages and features of the invention will be apparent from the following description of preferred embodiments, considered along with the accompanying drawings.

DESCRIPTION OF PREFERRED EMBODIMENTS

Figure 1:
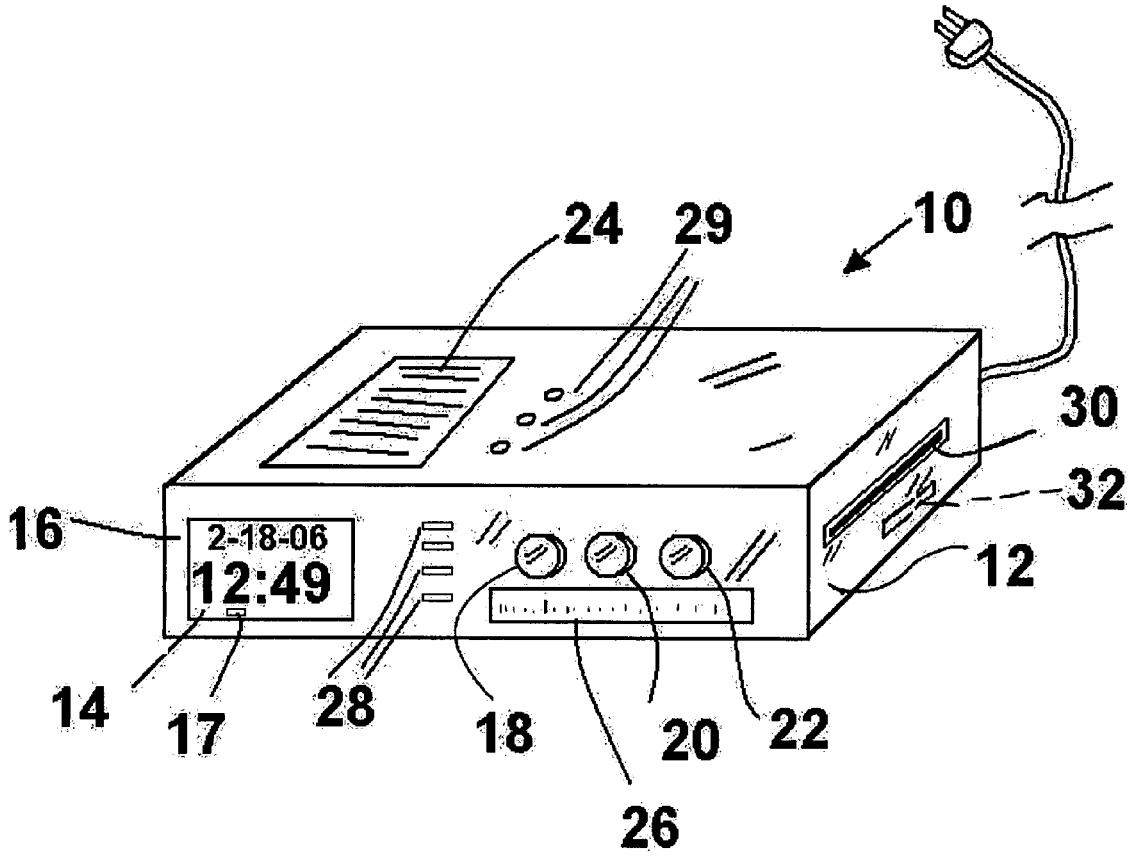
FIG. 1 is a perspective schematic view indicating a clock radio that has the features of the invention.

In the drawings, FIG. 1 shows a clock radio 10 in one form which incorporates the principles of the invention. The device 1 has a clock body or housing 12 with a time display 14, preferably a liquid crystal display as shown, and this display in preferred embodiments also displays the date, at 16. A separate display for the date could be provided. If desired the date display could be omitted if the date is maintained by an internal microprocessor as noted below. An alarm status LED is at 17, and rotatable knobs are shown at 18, 20 and 22, such as for on/off, adjustment of volume, bass/treble adjustment and AM/FM setting for radio broadcast sound that is projected from a speaker opening 24 on the housing. The display of radio bands is shown at 26. Rather than rotational dials, push buttons can be provided if desired, and such buttons are shown at 28. These buttons or dials can be wired or programmed for use in any manner as is typical of such appliances, including clock radios, televisions, automotive clocks and radios, etc.

A number of items must be set in the clock radio device 10 of the invention. These include the time and the date, unless an internal microprocessor maintains these settings using an internal battery, not subject to whether or not power is connected to the device 10; an alarm time set feature; a setting for selection of the type of message to be played, if this selection is provided (see below); optionally, a repeat button to repeat a verbal message which has just been played, if desired; "seek" or "tune" buttons for the radio, as known on other radios; a button for selection of the type of alarm to be played at the set time, e.g. alarm buzzer, radio, or verbal message, or several or all of the above, preferably in succession; and, in the case of horoscopes, the user's birth date or simply the user's zodiac sign. As in other such appliances, the LCD display 14 can be used for multiple functions, and can be used for setting a date of birth (which will be displayed temporarily as the time display is interrupted, as when a button is held down), in the event horoscope messages are stored. Even in the case where "generic" horoscopes are presented, only twelve of which may be stored for each day of the year, the user can be prompted to enter a birth date and the device 10 will select an appropriate zodiac sign message based on that information. Also, it should be understood that the clock radio 10, or a removable digital storage device for the clock 10, can be sold for the particular zodiac sign, so that twelve different models, preferably of the removable digital storage device, can be made available. Online downloading for specific zodiac signs or specific birth dates or birth dates/times can greatly reduce the volume of messages to be stored, as mentioned above, and can provide for updates as needed.

FIG. 1 shows a CD slot 30 for one specific embodiment of the invention. In this embodiment, a CD containing all of the multiplicity of messages to be presented by the device 10 is contained within the housing 12 in a CD player (not seen in the drawing). Whenever an alarm set time is reached, and assuming the playing of a "message" has been selected by the user, the unit 10 plays the appropriate message from the multiplicity of messages in accordance with the appropriate sign of the zodiac and the date. Or, the unit plays another type of appropriate message as discussed above, such as "this date in history" or "this date in sports history", etc., based only on the current date.

For a unit 10 with CD data storage, one of the buttons of the groups 28 and 29 can be a CD eject button, although removal of the CD is an action taken only rarely or at great intervals, and it is preferred that a user's manual must be consulted to obtain codes for operation of the buttons 28 and/or 29 to eject the CD to replace it with another. This is further discussed below.

As an alternative, and as mentioned above, the digital storage can be in the form of a solid state memory such as a flash drive or digital camera type solid state memory card. A slot or door 32 is indicated in FIG. 1 for such a solid state memory device. In a preferred embodiment this would comprise a type of door, similar to that on a digital camera, which is opened to release the memory card. Other configurations of receivers and/or connections can be used, as desired and appropriate for the particular type of solid state memory used.

As mentioned above, in one preferred embodiment the solid state memory can be re-written, that is, all data erased and replaced. Such data can be downloaded over the Internet, with the solid state memory device positioned in a slot of a user's computer or of a peripheral device to the computer. This enables time-appropriate messages such as horoscopes, which will vary between individuals, to be customized to the particular user and thus to require much less storage. This data re-recording and replacement relies on the customer-removable digital data storage device, allowing the consumer/user to remove the memory card or device and to download new data to be recorded on the storage device using the consumer's computer. Complete customization is possible, even allowing for elaborate and specific horoscopes for an individual user's birth date including year and time of day. Only 365 downloadable horoscopes are required for this customized storage of horoscopes, versus 12×365 horoscopes for merely data generic horoscopes for all persons under the same sign of the zodiac.

Another way of obtaining this same result for specific horoscopes is for the consumer to purchase the clock or clock radio, then order the digital data storage device customized to the particular customer's date, year and time of birth. Such customized collections of horoscopes can be produced in a computerized system at a central location, then sent to the user. In the case of such customized collections of horoscopes, the user need not input his/her birth date, year and/or time of birth, since this information will be contained in the removable digital storage device, but the user's information can be displayed on the clock device's LCD display, read from the digital storage device, if desired.

Figure 2:
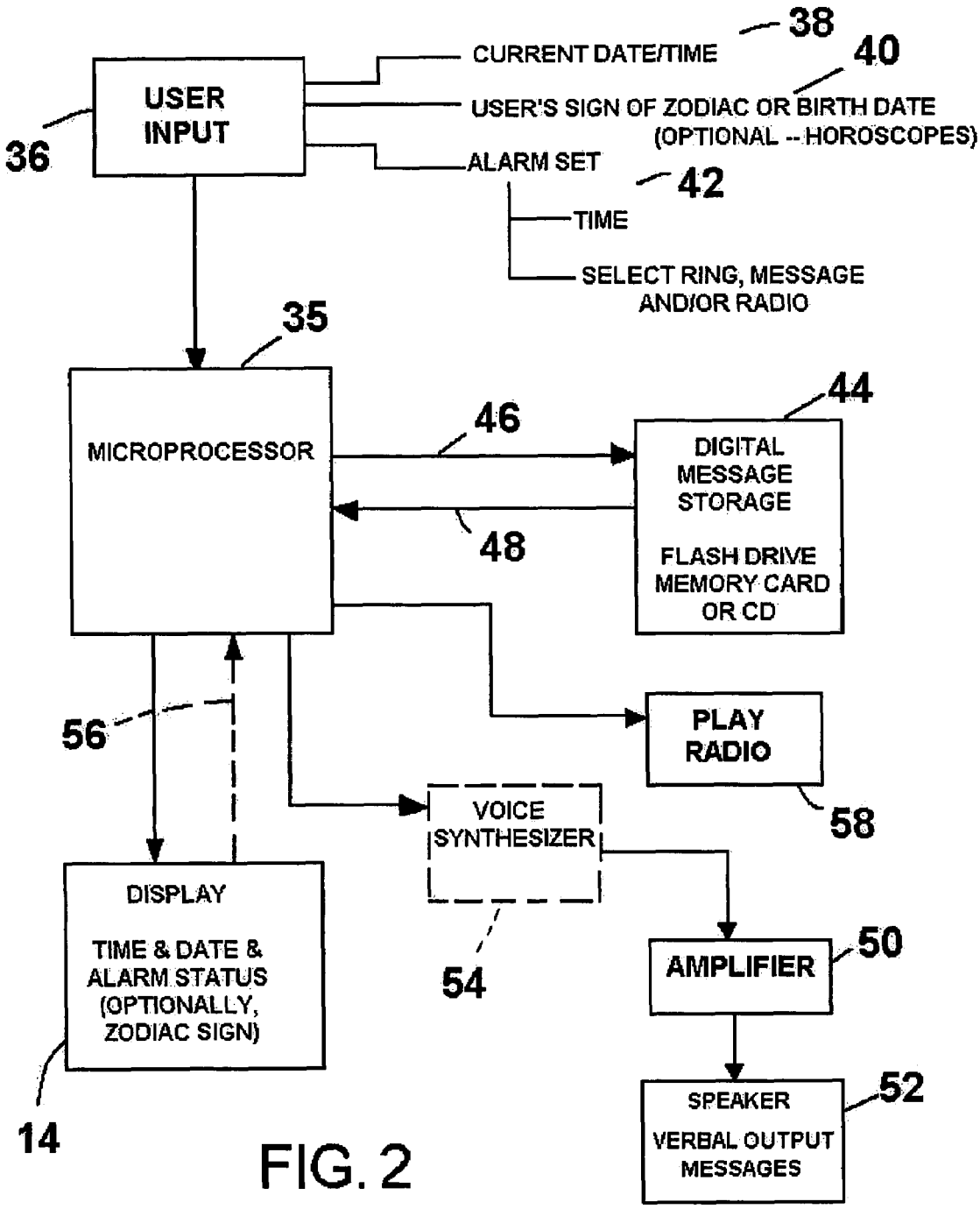
FIG. 2 is a simple block diagram showing a system according to the invention.

FIG. 2 shows a simplified schematic block diagram. Controls for the radio are not shown in this diagram. The drawing shows a microprocessor 35 at the heart of the system, contained within the clock radio body 12. User input is indicated at 36, represented by the setting buttons 28 and 29 shown in FIG. 1. The user inputs include setting of the current date and time, indicated at 38, entry of the user's date of birth or sign of the zodiac, indicated at 40, for the case where the stored messages are horoscopes or other messages that are keyed in some way to the user's date of birth (unless custom horoscopes are recorded as discussed above). Alarm setting is indicated at 42, which includes setting the time for the alarm, and optionally, selection of an alarm ring (or buzzer or other tone) or verbal message, or radio. In one preferred form two or all three of these audible wake-up signals or sounds can be selected, and they will be played in a particular order, such as radio, ring, message. The radio can be interrupted for the ring or the message, if desired, as a feature preset in the unit, such that the radio resumes playing afterward. The unit can allow setting the radio to start playing earlier, with the message coming at a later set time, with radio interruption. Note also that multiple user set times can be provided for, a "dual alarm" feature. Multiple users (normally two) can then set individual alarm/message times, and different types of messages could be selected for each, assuming multiple categories of messages are stored, as discussed below.

User inputs can also include inputs for other operations, such as changing the CD from the slot 30, if a CD is used as the digital storage for the device, or for releasing a solid state memory device from the optional slot or door 32, if that type of memory is used, or for selecting a language for the message, if multiple languages are provided.

As noted above, the microprocessor 35 preferably controls many functions of the clock radio unit 10. It is possible for the system to use an internal clock for all clock and date functions, supported by an internal battery that lasts, for example, about five years or more. In this case the user need not set the current date and time, but may need to use an input button to change from "summer time" to "winter time", for daylight savings changes.

FIG. 2 shows that the microprocessor or controller 35 interacts with the digital message storage medium 44. Whether this storage medium 44 is a flash drive or other solid state memory device, or a CD with a reader, the controller 35 addresses the storage device 44, as indicated at 46, to select the appropriate message. In many cases, (other than the case of horoscopes when messages for all twelve signs of the zodiac are stored for each day) this is simply a matter of addressing the appropriate storage location using a code that represents the current date. A message is then retrieved to the controller or processor 35, as indicated at 48. Assuming this is a digital voice recording, it is taken by the controller 35 and decoded to produce audible voice. In the case of a CD, the processor 35 can be part of a reader for the CD; or the CD can have a dedicated reader as part of the storage device indicated at 44, with the processor 35 simply feeding the stream of audio through. From the processor or controller 35, the audio is fed through an amplifier 50, which can be the same amplifier serving the radio for broadcast audio, and the amplified audio plays through a speaker or speakers 52 of the unit 10.

As noted above the system can alternatively include a voice synthesizer, indicated in dashed lines at 54. This can enable the messaging storage medium 44 to contain considerably more messages, as discussed above.

FIG. 2 shows the display 14 as controlled by the microprocessor or controller 35. What is displayed is shown as time and date, alarm status, and optionally, the zodiac sign of the user, as determined from the input of a birth date by the user or as directly entered by the user. This is the manner which the unit is operated in a preferred embodiment. However, these display functions could be independent of the microprocessor 35, and could be simple electronic functions that stem from the settings input by the user. These functions can be supported by a separate and simple microprocessor, of the type contained in nearly all modern clock radios (but optionally with the zodiac sign-indicating function). In that case the controller 35 can receive information from the display driver or processor controlling the display as indicated in a dashed information flow line 56 in the drawing.

FIG. 2 also shows a box indicating "play radio", at 58. This is shown on the control of the processor 35, but this is not necessarily the case. The processor can be involved if a button switch is operated by the user, this causing the processor 35 to relay instructions to turn on the radio. This function can be handled in the way a typical clock radio is usually set up, and can be a separate user input (not shown) directly connected to the radio. Note that a remote device for the clock radio can be provided for controlling these functions and others.

Figure 3:
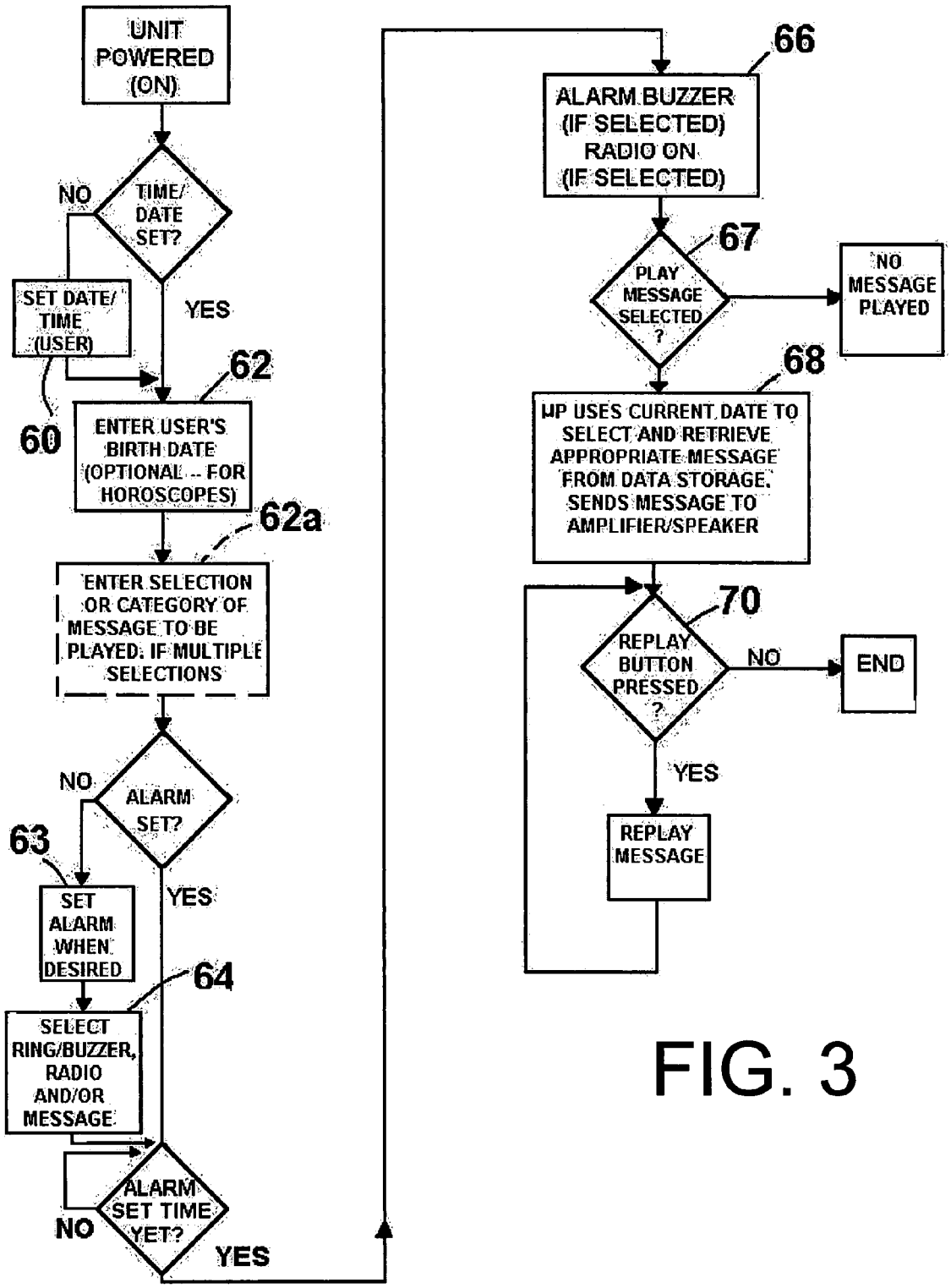
FIG. 3 is a simplified flow chart indicating operation of an embodiment of the invention, in the form a clock radio.

FIG. 3 is a simplified flow chart showing a routine in operation of the unit 10. The operation relates to the setting of time and date by the user, indicated in the box 60, entry of the user's birth date at 62, in the event the unit 10 is to play horoscopes (unless the memory device is customized), and alarm set routine, indicated at blocks 63 and 64. When the alarm set time is reached, the block 66 indicates activation of the alarm buzzer and/or the radio, according to what has been selected by the user. The unit checks to see if the user has made an input that a message should be played, as in the query box 67, and if so, the diagram shows at 68 that the processor or controller 35 uses the current date (whether contained in the processor itself or derived from a clock or a separate clock processor) to select and retrieve the appropriate message from data storage. The processor sends a message to the amplifier and to the speaker, through which the audio voice message is played.

Optionally, the unit includes a message replay button, and if so, the system queries at 70 whether replay has been requested by the user, which generally would occur during the playing of the message or within a preset time duration thereafter. If so, the message is played again, as indicated in the block 72.

As discussed above, the system can include in the digital message storage several different types of themes or categories of messages. This will require considerably more message storage capacity, but if this feature is included, the user can select among, for example, message topics such as great moments in history, great events in sports, great discoveries in science, birthdays of famous people, current positions of the sun, moon and/or stars or planets, or educational messages for children. In that case another setting by the user is required. This selection is indicated in the dashed-line block 62*a* in FIG. 3.

The preferred embodiment above refers primarily to time-sensitive messages, appropriate to the date when played, or to the time of day, week of the year, season, etc. However, the invention also encompasses the self-contained device that plays any kind of a message as desired by the user, whether time-appropriate or not, with the device including a consumer-removable and replaceable memory storage that contains the messages. As discussed above, these messages can be an appropriate type of high-density storage device such as a flash drive, memory card or other solid state memory device, or a removable CD. With the digital memory device being removable by the customer/user of the clock device, far more versatility is enabled than in a sealed unit that contains a set of messages not changeable by the user. As described above, horoscopes can be customized to the particular person, as to birth date and even time of day of birth, without requiring large data storage, by using customized downloads or customized data recording for the customer at a remote location. Similarly, multiple digital memory storage devices can be included with the clock device, each one having a different theme or category of message, or different memory storage devices for different user languages if desired. These could be interchangeably inserted into a single slot in the clock or clock radio, as desired by the user, or the clock device could even include multiple slots, to be selected from internally in accordance with the user's choice of category.

Many different types of messages can be presented for the user, including, in addition to those described above, educational messages for children, with foreign language instruction, mathematics, science, astronomy, etc., several different facts or brief stories each day; moral stories or fairy tales; nursery rhymes or songs; twelve-step programs for Alcoholics Anonymous or other "anonymous" or step-type programs, one played each day; meditation messages; trivia; nutritional information; or any other subject of interest to the user for a morning message (or other time of day), or a plurality of messages each day.

Messages preferably have a length between about fifteen seconds and thirty seconds, although this could vary. An example of a horoscope message might be, for example, as follows:

"Good morning, Libra, this is October 21. Today is a good day for you to invest in the stock market, to avoid extended automobile travel, and to drink plenty of liquids. Also, avoid any type of conflict with any other person on this day. On this day be sure to be well rested and as alert as possible—your signs are not good for alertness, logic and social compatibility."

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A clock having self-contained audio features to present to a user a time-appropriate message, comprising:

a clock with a time display and a clock body, a microprocessor contained in the clock body, and a user-removable, replaceable, pre-recorded digital storage medium contained in the clock body and connected to the microprocessor, accessible from exterior of the clock body, storing a multiplicity of audio verbal messages recorded by other than the user prior to acquisition of the pre-recorded digital storage medium by the user, each message having informative content of general interest directed at a multiplicity of users and appropriate for and relating to a particular time period, day or time of day, the clock device and clock body having at least one receptacle for the digital storage medium, accessible to the user at the outside of the clock body such that the digital storage medium is removable and replaceable by the user, an audible output in the clock body for delivering an audio verbal message, connected to the microprocessor so as to verbally announce an audio message selected from the multiplicity of messages when so directed by the microprocessor, and the microprocessor having means for selecting one of the multiplicity of stored messages for audio presentation to a user based on particular significance of the one stored message to the current time of day, day of week, or date.

2. A clock according to claim 1, wherein the clock comprises a clock radio, with means for setting the clock radio to present a selected audio message for presentation to the user at a wake up time, the message to be appropriate for the time, day or date for which the clock radio is set.

3. A clock according to claim 2, wherein the stored messages are horoscopes.

4. A clock according to claim 1, wherein the stored messages are horoscopes.

5. A clock according to claim 4, further including a data input on the clock body for a users's input of data relating to the user's date of birth, and wherein the horoscopes are specific to dates of birth.

6. A clock according to claim 5, wherein the horoscopes include, for each day of the year, a different horoscope for each of the twelve signs of the zodiac, with a single horoscope message for all persons under a particular zodiac sign on a particular day.

7. A clock according to claim 5, wherein the clock is self-contained and not connected to any network.

8. A clock according to claim 1, wherein the multiplicity of messages describe historical events which happened on particular dates, and the means for selecting causing a message to be presented from a day of the year in history which is the same as the current day of the year.

9. A clock according to claim 8, wherein the multiplicity of messages include a plurality of different categories of historical events, and the clock body including a user input for selection of a desired category.

10. A clock according to claim 9, wherein the different categories of historical events include sports events.

11. A clock according to claim 9, wherein the different categories of historical events include political events.

12. A clock according to claim 9, wherein the different categories of historical events include events in science.

13. A clock according to claim 9, wherein the different categories of historical events include news items.

14. A clock according to claim 9, wherein the different categories of historical events stored in the digital storage medium include a different message for each day of the year and are appropriate for any year.

15. A clock device according to claim 1, wherein the clock is self-contained and not connected to any network.

16. A clock device according to claim 1, wherein the digital storage medium includes in said multiplicity of messages a plurality of different categories or themes of messages, and the clock device including means for user selection of a category of message to be presented.

17. A clock device according to claim 16, further including a user selection input enabling the user to program the clock device to present different categories of messages on different days or groups of days.

18. A clock device according to claim 16, wherein the clock device includes a plurality of receptacles for digital storage media.

19. A clock device according to claim 1, wherein the digital storage medium comprises a solid state memory card.

20. A clock device according to claim 1, wherein the digital storage medium comprises a re-writeable solid state memory card.

21. A clock having self-contained audio features to present to a user a message at a selected time, comprising:

a clock device with a time display and a clock body, a microprocessor contained in the clock body, and a user-removable, replaceable, pre-recorded digital storage medium contained in the clock body and connected to the microprocessor, accessible from exterior of the clock body, storing a multiplicity of audio verbal messages recorded by other than the user prior to acquisition of the pre-recorded digital storage medium by the user, each message having informative content of general interest directed at a multiplicity of users, the clock device and the clock body having at least one receptacle for the digital storage medium, accessible to the user at the outside of the clock body such that the digital storage medium is removable and replaceable by the user, and an audible output in the clock body for delivering an audio verbal message, connected to the microprocessor so as to verbally announce an audio message selected from the multiplicity of messages when so directed by the microprocessor.

22. A clock according to claim 21, wherein the clock comprises a clock radio, with means for setting the clock radio to present a selected audio message for presentation to the user at a wake up time.

23. A clock according to claim 22, wherein the stored messages are horoscopes.

24. A clock according to claim 23, further including a data input on the clock body for a user's input of data relating to the user's date of birth, and wherein the horoscopes are specific to dates of birth.

25. A clock according to claim 24, wherein the horoscopes include, for each day of the year, a different horoscope for each of the twelve signs of the zodiac, with a single horoscope message for all persons under a particular zodiac sign on a particular day.

26. A clock according to claim 24, wherein the clock is self-contained and not connected to any network.

27. A clock according to claim 21, wherein the multiplicity of messages relate to historical events which happened on particular dates, and the means for selecting causing a message to be presented from a day of the year in history which is the same as the current day of the year.

28. A clock according to claim 27, wherein the multiplicity of messages include a plurality of different categories of historical events, and the clock body including a user input for selection of a desired category.

29. A clock according to claim 28, wherein the different categories of historical events include sports events.

30. A clock according to claim 28, wherein the different categories of historical events stored in the digital storage medium include a different message for each day of the year and are appropriate for any year.

31. A clock device according to claim 21, wherein the clock device includes a plurality of receptacles for digital storage media.

32. A clock device according to claim 21, wherein the digital storage medium comprises a solid state memory device.

33. A clock device according to claim 21, wherein the digital storage medium comprises a re-writeable solid state memory device.

34. A method for automatically playing for a user messages at times preset by the user, comprising:

providing a clock device with a time display and a clock body, with a microprocessor contained in the clock body and a user-removable, replaceable, pre-recorded digital storage medium contained in the clock body and connected to the microprocessor accessible from exterior of the clock body and storing a multiplicity of audio verbal messages recorded by other than the user prior to acquisition of the pre-recorded digital storage medium by the user, each message having informative content of general interest directed at a multiplicity of users, and the clock body having an audible output for delivering an audio verbal message, the output being connected to the microprocessor so as to verbally announce an audio message selected from the multiplicity of messages when so directed by the microprocessor, the clock body having at least one receptacle for the digital storage medium, accessible to the user at the outside of the clock body such that the digital storage medium is removable and replaceable by the user, the user's setting a time of day for playing of a message, so that the clock device, through the microprocessor, causes an audio verbal message to be played at the time selected by the user, the user's changing the content of the digital storage medium when desired, by removing the digital storage medium from the clock body, connecting the digital storage medium to a computer and downloading, through an Internet connection of the computer, new audio verbal content to the digital storage medium by over-writing the existing multiplicity of messages and replacing them with a new multiplicity of messages, and the user's replacing the digital storage medium into the clock body.

* * * * *